United States Patent [19]

Franklin et al.

[11] 4,367,254

[45] Jan. 4, 1983

[54] WEATHERSTRIP WITH BARRIER FILM HAVING PARALLEL FOLD LINES

[75] Inventors: Timothy W. Franklin, Luton, England; Paul G. Declercq, Kortrijk; Michael M. Henno, Ostend, both of Belgium

[73] Assignee: Schlegel (UK) Limited, Seacroft, England

[21] Appl. No.: 196,674

[22] Filed: Oct. 14, 1980

[30] Foreign Application Priority Data

Oct. 16, 1979 [GB] United Kingdom ..... 7935956
Dec. 28, 1979 [GB] United Kingdom ..... 7944445
Apr. 11, 1980 [GB] United Kingdom ..... 8011975

[51] Int. Cl.[3] ..... D04H 11/00; E06B 7/22

[52] U.S. Cl. ..... 428/85; 49/489; 52/108; 156/72; 428/89; 428/92

[58] Field of Search ..... 428/85, 89, 92; 156/72; 49/489; 52/108

[56] References Cited

U.S. PATENT DOCUMENTS 4,214,930 7/1980 Burrous ..... 156/1

*Primary Examiner*—Marion McCamish
*Attorney, Agent, or Firm*—Cumpston & Shaw

[57] ABSTRACT

Weatherstripping for minimizing or eliminating draughts around doors, windows and the like comprising a flexible backing strip having sealing material projecting from at least one of its surfaces, preferably of pile material, and wherein at least one barrier fin is located within the sealing material and extends generally at right angles away from the face of the backing strip to which the sealing material is attached, the fin incorporating therein a plurality of fold lines extending substantially parallel to each other about which the fin is folded so as to define a generally zig-zag fin arrangement. The zig-zags may extend the full height of the fin or may be provided just at the upper end of the fin and in a particular construction, the free end portion of the fin is turned over so as partially to overlie some of the sealing material in use.

7 Claims, 4 Drawing Figures

WEATHERSTRIP WITH BARRIER FILM HAVING PARALLEL FOLD LINES

Figure 1:
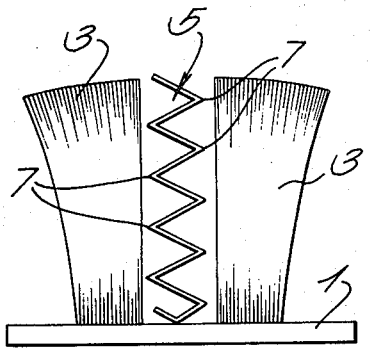

This invention relates to weatherstrips primarily for forming a draught excluder around doors and windows. The invention is an improvement over the subject of our U.K. Patent Specification No. 1000753. The invention is particularly applicable to pile weatherstripping.

Pile weatherstripping incorporating an impermeable barrier film within the pile material has excellent weathering properties, but the presence of the barrier film can cause problems, both with sliding windows, whether of the sash type or of the horizontal sliding type, and with the hinged casement and horizontal pivot windows. For example, the presence of the film increases the breakaway force needed to overcome the friction between window sash and weatherstrip when a window is to be opened. Furthermore, if the window or door is kept closed for a long time, a single barrier film tends to take a set, i.e. it remains in its partially collapsed state, even after the door or window has been opened, thus gradually reducing the weatherstrip's performance. Also, in certain situations, the film tends to collapse or fold over when the weatherstrip is inserted into a groove in a door or window, probably because of reverse bending of the weatherstrip during the insertion process. A further problem with known pile weatherstrip incorporating a barrier film is that it is rather stiff and resists compression when a door or window is to be shut. This means that to shut the window and compress the strip, considerable force must be applied to the door or window.

We have now developed improved weatherstrip incorporating a barrier film which redues or overcomes at least some of the above problems, the film (or fin) being secured to the backing strip or other part of the weatherstrip in known manner.

According to the present invention, we provide weatherstripping comprising a backing strip which is preferably flexible, and having sealing material projecting from one of its surfaces, and wherein at least one barrier film or fin is located within the sealing material and projects from the backing strip in the same direction as the sealing material, said film or fin incorporating therein a plurality of fold lines running throughout the length of the weatherstripping and extending substantially parallel to the backing strip, and spaced therefrom.

Preferably, the sealing material is pile.

In one construction, more than three fold lines are provided in the fin throughout its depth, thus forming a concertina construction. Alternatively, the concertina construction may be provided just in the upper portion of the fin.

According to a further embodiment of the present invention, we provide a weatherstripping as described above with a concertina-like film or fin therein wherein the upper edge region of the film or fin incorporates at least one further fold line therein. The film or fin is folded about this fold line in the same sense as the next fold in the concertina so as at least partly to overlie the sealing material to one side of the film or fin.

If desired, two such fold lines may be provided extending parallel to each other, and the free edge portion of the film or fin can be folded about each fold line in the same sense so that a loop is provided at the top of the film or fin.

Several embodiments of pile weatherstrip in accordance with the invention are now described by way of example with reference to the accompanying schematic drawings, in which FIGS. 1 through 4 are cross-sectional views, and like parts have the same reference numerals.

Referring to FIG. 1, the weatherstrip has a traditional flexible backing strip 1 from one face of which the traditional pile material 3 of the required height and density upstands. Within the pile material, a fin 5 is provided, the fin having a plurality of spaced fold lines 7 therein, all parallel to the backing strip 1. The fin is thus in the form of a concertina.

Figure 2:
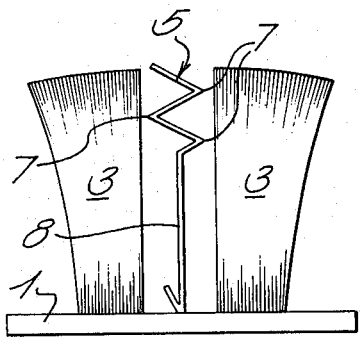

The construction shown in FIG. 2 differs from that of FIG. 1 only in that the concertina construction is formed just in the upper part of the fin. The remainder of the fin is of traditional, straight construction, as shown at 8.

Figure 3:
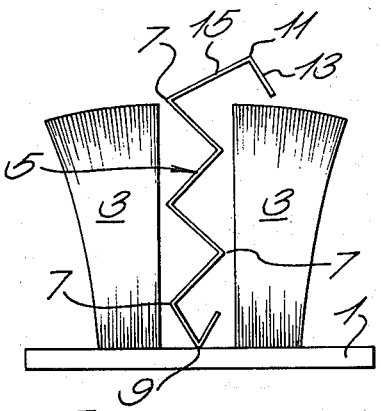

Referring to the construction shown in FIG. 3 of the drawings, the top or free edge portion of the fin 5 incorporates a further fold line 11 therein extending parallel to the other fold lines 7, and between this fold line 11 and the free or top edge of the fin is a portion 13 which is folded over in the same sense as the adjacent portion 15. The remaining portions between the fold lines 7 are of course folded so as to give a zig-zag configuration. The portion 13, because of the way in which it is folded over in the same sense as the portion 15, tends to overlie the pile material 3 to one side of the fin 5.

Figure 4:
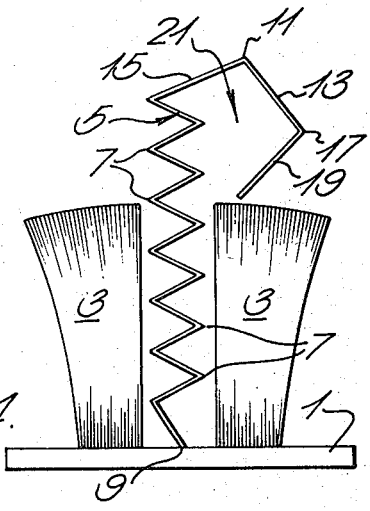

The construction shown in FIG. 4 is similar to that shown in FIG. 3 although the method of connection (at the point 9) of the fin 5 to the backing strip 1 is slightly different. Furthermore, a further fold line 17 parallel to the fold line 11 is formed in the top region of the fin 5, effectively dividing the portion 13 into two parts, the second of which is identified at 19. This part 19 is again folded in the same sense as the parts 13 and 15 about the respective fold lines 17, 11 and 7 so as to define what is almost a loop 21 at the top of the fin.

Because of the provision of the folded over portions 13, 15 and the further part 19, the free top edge of the fin 5 lies over the pile material in a consistent direction. This prevents the problem of "snaking" which is sometimes found to occur in prior art edge trims incorporating a barrier film. By snaking we mean the phenomenon wherein the barrier film, when forming sealing engagement with a co-operating member, tends to lie over alternately to the left and to the right (as viewed in the drawings). Where a change in direction of the fin occurs, there is a tendency for an air gap to be present, instead of the fin forming a continuous seal against the co-operating member.

Furthermore, by having the folded over portions lying over a part of the pile material, a sealing area of impervious material which will be greater than would occur with a standard fin is provided.

In all the above constructions, the pile material will maintain and support the vertical stature of the fin.

Because of the above-described fold lines defining the concertina, the fins can collapse easily, and hence it does not require too much effort to shut a hinged door or window fitted with such weatherstrip.

While it is preferred that pile material be provided on the backing strip 1 to either side of the fin 5, it will be appreciated that other types of known or new sealing material could be used, such as foamed polymeric material, felt or the like.

The concertina fin arrangement which is akin to a crimped fin, allows much less compressive force than a normal fin, thus making it easier to shut hinged doors or windows with which the weatherstrip is used, and yet air infiltration values are similar to those of weatherstrip having a traditional fin. It is believed that this is because the fin acts as a bellows, adjusting to compression easily yet not losing any of its effectiveness as a draught excluder.

It is also believed that the concertina-like fin will tend to lengthen during use when subjected to a wind load, thus increasing its effectiveness as a seal.

Furthermore, it is believed that the concave nature of the troughs in the concertina-like fin cause air and sound to be reflected.

We claim:

1. Weatherstripping comprising a backing strip, sealing material projecting from at least one of the surfaces of said backing strip and at least one barrier film located within said sealing material and extending generally at right angles to the face of said backing strip, and wherein a plurality of generally parallel spaced fold lines run throughout the length of said film and extend substantially parallel to said backing strip and are spaced therefrom to provide a generally concertina-like construction.

2. Weatherstripping according to claim 1 wherein said barrier film projects upwardly from said backing strip and extends generally normal thereto.

3. Weatherstripping according to claim 1 wherein said sealing material is pile.

4. Weatherstripping according to claim 1 wherein a plurality of fold lines are provided in said film throughout its depth and the material of said film is folded to and fro in opposite senses so as to form a concertina-like construction.

5. Weatherstripping according to claim 1 wherein a plurality of fold lines is provided in said film throughout its upper portion and the material of said film is folded to and fro in opposite senses so as to form a concertina-like construction, the lower portion of said film being straight.

6. Weatherstripping according to claim 1 wherein at least one further fold line is provided in the upper edge region of said film about which further fold line said film is folded and wherein said film is folded about said further fold line in the same sense as the adjacent portion in said concertina-like construction so that the upper edge region of said film at least partly overlies said sealing material to one side of said film.

7. Weatherstripping according to claim 1 wherein two further parallel fold lines are provided in the upper edge region of said film and wherein the free edge portion of said film is folded about said two further fold lines in the same sense so that the free edge of said film hangs downwardly oversaid sealing material to one side of said film.

* * * * *